US005297876A

United States Patent [19]

Imagawa

[11] Patent Number: 5,297,876

[45] Date of Patent: Mar. 29, 1994

[54] PAGE PRINTER WITH INTERNAL AND EXTERNAL MEMORIES

[75] Inventor: Shinji Imagawa, Yao, Japan

[73] Assignee: Sharp Kabushiki Kaisha, Osaka, Japan

[21] Appl. No.: 896,098

[22] Filed: Jun. 10, 1992

[30] Foreign Application Priority Data

Jun. 10, 1991 [JP] Japan ..... 3-137844

[51] Int. Cl.[5] ..... B41J 5/48

[52] U.S. Cl. ..... 400/61; 395/116

[58] Field of Search ..... 400/61, 70, 76; 395/115, 116

[56] References Cited

U.S. PATENT DOCUMENTS 4,837,737 6/1989 Watanabe ..... 400/61

5,142,614 8/1992 Schneider ..... 395/115

FOREIGN PATENT DOCUMENTS 82220 3/1989 Japan ..... 400/121

2-4925 1/1990 Japan ..... 400/121

*Primary Examiner*—David A. Wiecking

*Assistant Examiner*—Steven S. Kelley

*Attorney, Agent, or Firm*—David G. Conlin; George W. Neuner

[57] ABSTRACT

A page printer for printing a document by a page on receiving printing data sent from an external device. The printer comprises printing engine for performing a printing process based on page data and a page data preparing section for preparing page data on printing data input from the external device. The printer is provided with an external memory for storing prepared page data and control section for alternatively selecting either the external memory or the page data preparing section. The control section supplies the printing engine with page data from selected one of the page data preparing section and the external memory based on the selection.

7 Claims, 3 Drawing Sheets

PAGE PRINTER WITH INTERNAL AND EXTERNAL MEMORIES

BACKGROUND OF THE INVENTION

1. Field of the Invention

This invention relates to a page printer that includes a print engine for printing a document by the page and a data preparing section for preparing page data for one page on the basis of print data input, and supplying the page data to the print engine to perform a printing process.

2. Description of the Related Art

Generally, a conventional page printer is connected through an interface cable to a terminal device, which has a word processing function, of a host computer, for example. When a text prepared in the terminal device is printed by the page printer, print data including character codes is sent from the terminal device through the interface cable to the page printer, and the page printer analyzes the print data, and prepares a bit pattern corresponding to one page and stores in the database in the RAM. In the above-mentioned analysis process, the CPU constituting a control section of the page printer reads a font pattern that matches the input character code from a CG-ROM having font patterns of different characters stored therein, and forms a bit pattern of the font, which was read, in a specified position in the database. In a case that outline font patterns are stored in the CG-ROM, the above-mentioned analysis process includes the development of a mathematical formula expressing different outline font patterns. Bit patterns for one page obtained by this analysis process, that is, page data is supplied to a control section of the print engine in synchronism with a drive timing of the print engine that actually executes printing, and the print engine prints a text for one page on a sheet of paper on the basis of the page data.

However, there has been no conventional page printer that has been arranged to preserve the page data prepared by the analysis process after printing is finished. For this reason, when a text prepared by the operator has been printed by the page printer and the same text is to be printed again as occasion demands, the print data must once again be sent from the terminal device to the page printer through the interface cable and analyzed, so that it takes a long time until printing of the text is finished through the same text printed once before is printed again.

When the execution of the word processing program for creating or formatting a document has been terminated in the terminal processor or the power supply to the terminal device has been turned off, the word processing program needs to be started, then text data stored in a floppy disk, for example, is loaded, followed by the transmission and analysis of the print data as described above. Thus, a longer time is required till the end of printing of the text.

SUMMARY OF THE INVENTION

It is therefore an object of the present invention to provide a page printer capable of completing the printing process in a short time when the same text is printed again.

Another object of the present invention is to provide a page printer that can obviate the need to transmit from the terminal device and analyze the print data to perform the printing process of the same text for the second time, and thereby eliminate the time for those steps from the printing process.

Those and other objects of the invention can be achieved by a page printer comprising printing means for performing a printing process according to page data, page data preparing means for preparing page data on print data input, external memory means for storing the above-mentioned page data, selecting means for alternatively selecting either the above-mentioned external memory means or the above-mentioned page data preparing means, and supply means for supplying the above-mentioned printing means with page data from selected one of the page data preparing means and the external memory means according to the selection by the above-mentioned selecting means.

According to the above-mentioned page printer, page data prepared by the page data preparing means is stored in the external memory means. Therefore, data concerned with a text that has been printed is preserved in the external memory means of the page printer itself. When a document once printed is printed again, the data related to this text can be read from the external memory means that the page printer possesses, and a printing process can be executed according to this data, so that print data need not be sent again from the terminal device. In addition, since prepared page data is written in the external memory means, it has become unnecessary for the page printer to prepare page data, thus substantially decreasing the time of the printing process.

Further objects and advantages of the present invention will be apparent from the following description of the preferred embodiment of the invention as illustrated in the accompanying drawings.

DESCRIPTION OF THE PREFERRED EMBODIMENT

Figure 3:
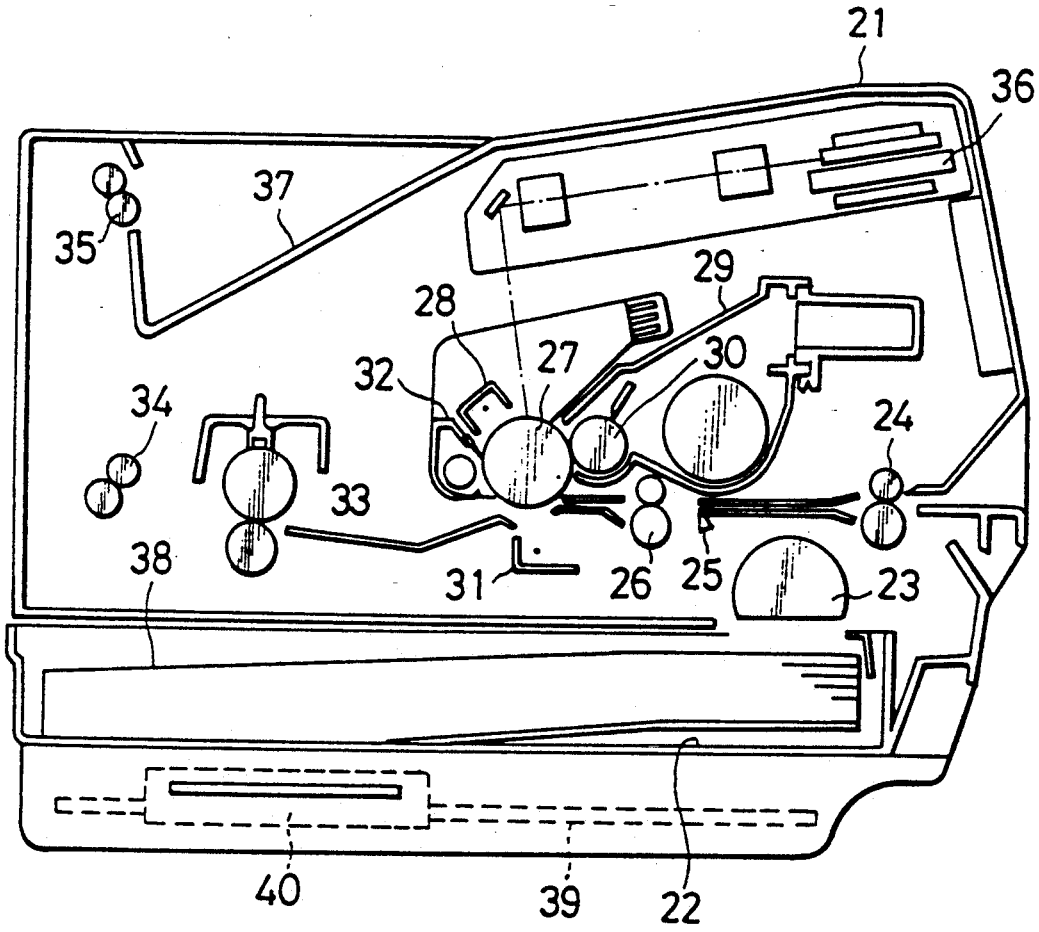
FIG. 3 is a sectional view showing the construction of a laser printer as an embodiment of the page printer according to the present invention.

FIG. 3 is a schematic diagram for explaining the construction of the print engine of the laser printer as an embodiment of the present invention.

Under a laser printer 21, there is mounted a paper cassette 22, in which multiple sheets of paper 38 are accommodated. The sheet 38 in the paper supply cassette 22 faces a paper supply roller 23 at a part of the upper face thereof, and the sheets of paper are guided sequentially to a pair of conveying rollers 24 starting with the topmost sheet by the rotation of the paper supply roller 23.

At the center of the laser printer 21, a photosensitive drum 27 is installed rotatably. Around the circumference of the photosensitive drum 27, there are provided a static charger 28, a developing device 29, a transfer charger 31, and a cleaner 32. Above those devices, there is installed a laser device 36.

By the arrangement of those devices, static charge with a single polarity is produced on the circumferential surface of the photosensitive drum 27 by the static charger, a laser light is irradiated to the photosensitive drum 27 by the laser device 36, and as a result, a desired latent electrostatic image is formed on the circumferential surface of the photosensitive drum 27. This latent electrostatic image is rendered visible by a developer applied by a developing roller 30 of the developing device 29. The visible developer-formed image is transferred to a sheet that has come to a position placed against the transfer charger 31.

As the paper supply roller 23 rotates, the conveying rollers 24 start to rotate, so that the sheet 38 supplied from the paper supply cassette 22 is sent by the rotation of the conveying rollers to a pair of resist rollers 26 provided before the transfer position. By the resist rollers 26, the leading edge of the image formed on the surface of the photosensitive drum is made coincident with the leading edge of the sheet 38. The resist rollers 26 are so arranged as to temporarily restrict the movement of the sheet 38 that has arrived and start rotating in synchronism with the rotation of the photosensitive drum 27. In front of the resist rollers 26 in the conveying path, a sensor 25 for paper detection is provided, so that the paper 38 being conveyed is detected by this sensor 25.

A pair of fixing rollers 33 is provided on the left side in the figure, at a middle height in the laser printer 21. The fixing rollers 33, while applying a constant pressure to the sheet 38, heats the sheet 38 that has finished the transfer process described above, whereby the developer-formed image transferred to the sheet is thermall fused and fixed on the sheet.

The sheet 38 that has passed the fixing rollers 33 goes through the conveying rollers 34 and eject rollers 35, and is ejected to an eject tray 37.

At the bottom of the laser printer 21, there are arranged a floppy disk as an external memory unit and a control board 39 having mounted thereon a circuit for controlling the devices described above and a circuit for performing the function of a page printer.

Figure 1:
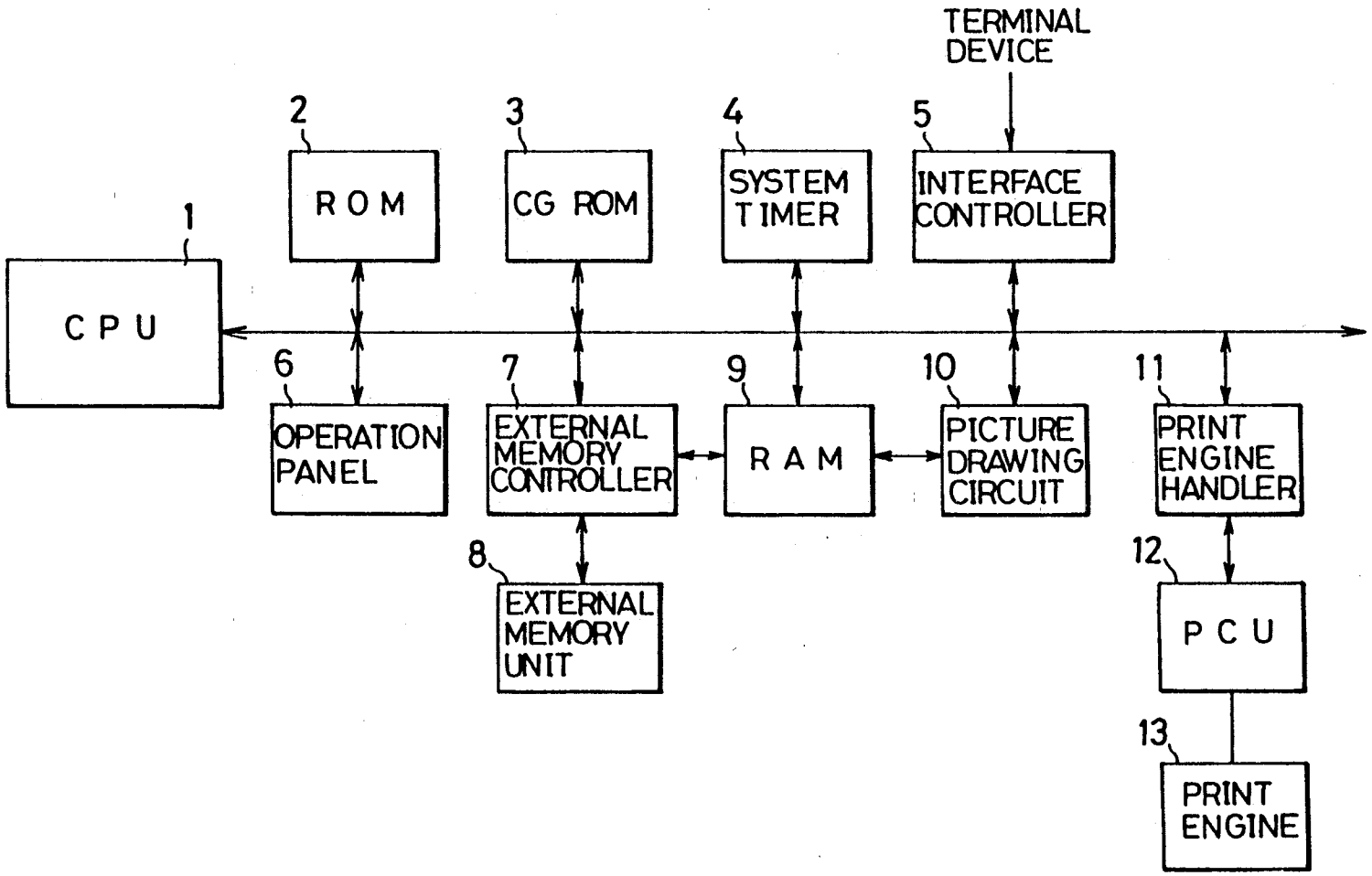
FIG. 1 is a block diagram showing a circuit configuration of an embodiment of the page printer according to the present invention.

FIG. 1 is a block diagram showing the circuit configuration on the control board 39 along with peripheral devices such as the print engine, the external memory unit, and the operation panel.

The control board 39 includes CPU 1 for controlling input/output devices. Connected through internal buses to CPU 1 are ROM 2, CG-ROM 3, a system timer 4, an interface controller 5, an operation panel 6, an external memory controller 7, RAM 9, a picture drawing circuit 10, and a print engine handler 11. ROM 2 has written therein procedures of CPU 1 in the printing process, and CPU 1 controls the input/output devices according to the procedures. The CG-ROM 3 stores font patterns of the characters. The system timer 4 determines the operation timing of CPU 1 in the printing process. To the interface controller 5, a terminal device having a word processing function is connected, and print data based on a document created or formatted at the terminal device is input through an interface cable, not shown. The operation panel 6 has keys and a display for making settings of the print engine, such as the number of copies printed in the printing process. Also provided on the operation panel are keys for selecting data input from a terminal device or selecting data storage in the external memory unit.

The external memory controller 7 has connected thereto an external memory unit 8, such as a floppy disk drive, which stores supplied data related to the printing process in an external memory medium such as a floppy disk. RAM 9 includes an area for temporarily storing print data sent from the terminal device, and a database for storing page data prepared in the analysis process. This analysis process, as in a conventional page printer, is a process for forming bit patterns for one page from the print data supplied from the terminal device. This analysis process is performed on print data sent from the terminal device even when the printing process by the print engine is under way. With regard to the analysis process, RAM 9 has a database for a plurality of pages taking into consideration cases where the analysis process is performed on print data sent from the terminal device while the printing process by the print engine is under way and the analysis process is more quickly done than the printing process in the print engine. The picture drawing circuit 10 executes the analysis process and when page data for the next page has been prepared, supplies the page data to the print engine handler 11. To the print engine handler 11, PCU 12 for controlling the drive of the print engine 13 is connected, and the print engine handler 11 outputs page data to PCU 12 according to the speed of the printing process of the print engine 13.

The above-mentioned external memory controller 7 is directly connected to RAM 9, and page data formed in the database in RAM 9 is supplied from the external memory controller 7 to the external memory unit 8.

Figure 2:
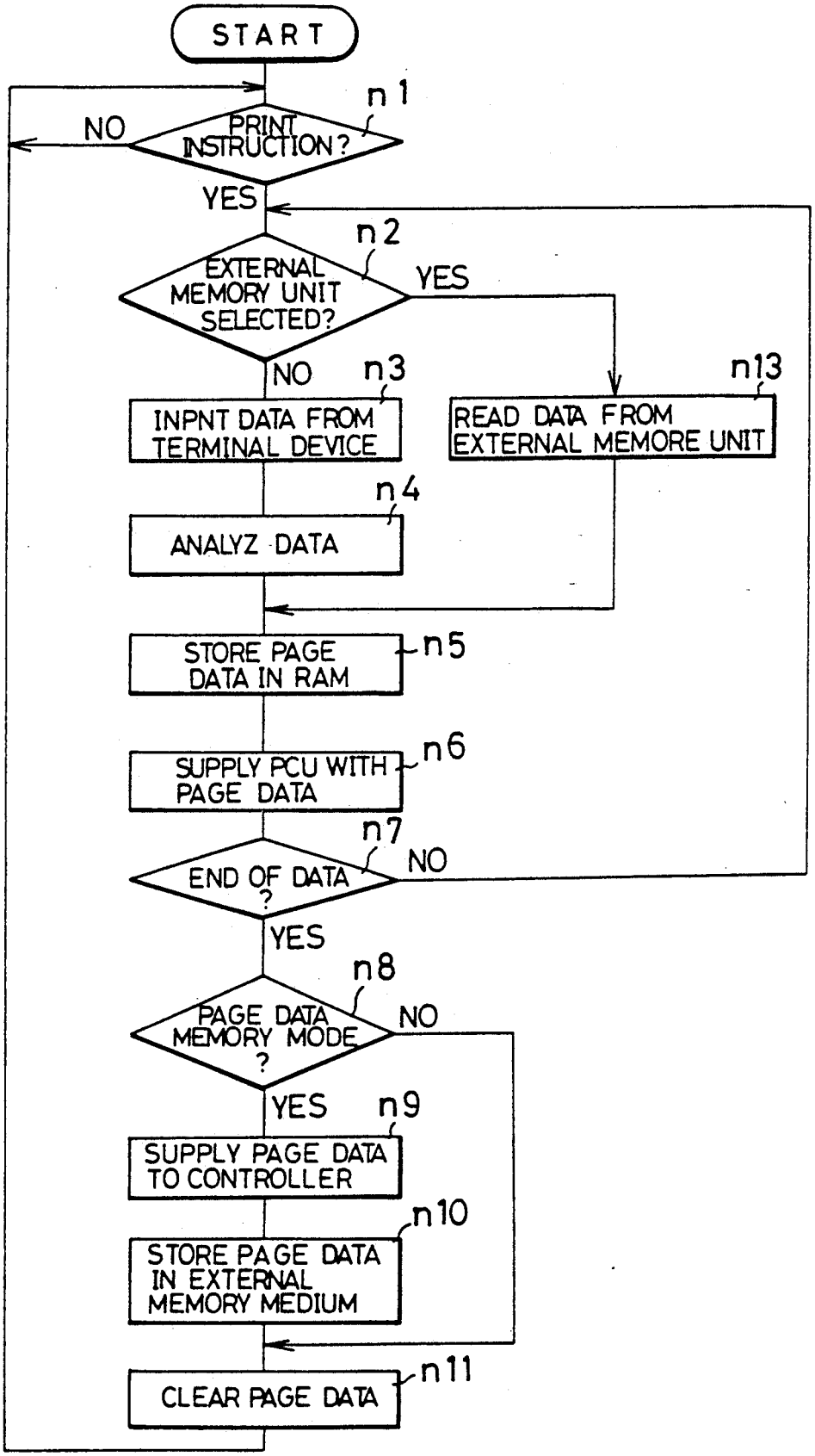
FIG. 2 is a flowchart showing the procedure at the control section.

FIG. 2 is a flowchart showing the procedure of the control section of the page printer. When power is supplied to the page printer, CPU 1 waits for input of a print instruction to start the printing process (n1). When a print instruction is input by key operation at the terminal device or the operation panel 6, a decision is made at the operation panel 6 whether or not a printing process has been selected to print page data stored in the external memory device (n2). If the printing process of data stored in the external memory unit has not been selected, print data input from the terminal device (n3) are accepted, and the analysis process based on this print data is executed by the picture drawing circuit 10 (n4). In this analysis process, the picture drawing circuit 10 reads from CG-ROM 3 font patterns corresponding to character codes included in print data temporarily stored in RAM 9, and forms bit patterns corresponding to the character codes at a specified position in the database of RAM 9. When outline font patterns are stored in CG-ROM 3, the analysis process includes the development of a mathematical formula for expressing those font patterns and a conversion process to a specified magnification. By the analysis process in the picture drawing circuit 10, bit patterns for one page are formed as page data in the database of RAM 9 (n5). When bit patterns for one page have been formed in RAM 9, the picture drawing circuit 10 supplies the page data to PCU 12 through the print engine handler 11 at specified timing (n6). The above-mentioned steps from n3 to n6 are executed until page data is exhausted which corresponds to print data sent from the terminal device.

After this, a decision is made on the operation panel whether the page data memory mode has been selected (n8). When the page data memory mode has been selected, page data formed in the database of RAM 9 is supplied to the external memory controller 7 (n9), and the page data is sent from the external memory controller 7 through the external memory unit 8 to an external memory medium for storage there (n10). When the storage of the page data in the external memory medium has finished or if the page data memory mode has not been selected, the page data formed in ROM 9 is cleared (n11), and CPU 1 returns to the waiting state for input of a print instruction.

When input of data from the external memory unit has been selected at step n2, page data is read from the external memory unit 8 through the external memory controller 7 (n13), and is stored in the database of RAM 9 (n5). In other words, when input of data from the external memory unit 8 has been selected on the operation panel 6, transfer of print data from the terminal device and the analysis process on print data are not executed.

As has been described, according to this embodiment, page data after the end of the analysis process on the print data can be read and written in the external memory unit 8 through the external memory controller 7. When a document that has been printed once is printed again, it is possible to omit the transfer of print data from the terminal device and the analysis process related to the print data, and the resulting advantage is a shortened time of the printing operation.

According to the present invention, in a case that a document that once has been printed is printed again, the page data used for printing can be read from the subordinate external memory device into the page printer, so that the transfer of print data from the terminal device for the second time is made unnecessary. In addition, as page data after the end of the analysis process is stored in the external memory means, the analysis process on the print data becomes unnecessary. This provides an advantage that time required for printing for the second time and beyond can be shortened substantially in repeatedly printing the same document.

Many widely different embodiments of the present invention may be constructed without departing from the spirit and scope of the present invention. It should be understood that the present invention is not limited to the specific embodiment described in the specification, except as defined in the appended claims.

What is claimed is:

1. A page printer for printing a document by a page on receiving printing data sent from an external device, said printer comprising:

printing means for performing a printing process based on page data;

page data preparing means for preparing page data based on printing data input received from the external device;

external memory means having a capacity for storing said prepared page data;

storage controlling means for supplying said prepared page data to said external memory means after printing the document to store said prepared page data into said memory means;

selecting means for alternatively selecting either said external memory to print out page data which have once been printed or said page data preparing means to print out newly prepared page data; and supply means for supplying said printing means with page data from a selected one of said page data preparing means and external memory means based on the selection by said selecting means.

2. A page printer according to claim 1, wherein said storage control means includes a memory mode selection key operable by a user, said storage control means storing page data output from said page data preparing means when a memory mode is selected by operating said memory mode selection key.

3. A page printer according to claim 2, wherein said storage control means includes means for deciding whether the memory mode has been selected.

4. A page printer according to claim 1, further comprising an external memory means selection key operable by a user, and read control means for reading page data stored in said external memory means when said external memory means is selected by operating said external memory means selection key.

5. A page printer according to claim 4, wherein said read control means includes means for making a decision as to whether the external memory means has been selected.

6. A page printer according to claim 1, wherein said supply means includes temporary memory means for temporarily storing page data read from said memory means or output from said page data preparing means.

7. A page printer according to claim 1, wherein said external memory means also stores print data input from the external device.

* * * * *